US007073785B2

(12) United States Patent
Leu et al.

(10) Patent No.: US 7,073,785 B2
(45) Date of Patent: Jul. 11, 2006

(54) APPARATUS FOR PROCESSING PRINTED PRODUCTS

(75) Inventors: Willy Leu, Pfaffikon (CH); Erwin Muller, Durnten (CH)

(73) Assignee: Ferag AG, Hinwil (CH)

( * ) Notice: Subject to any disclaimer, the term of this patent is extended or adjusted under 35 U.S.C. 154(b) by 1 day.

(21) Appl. No.: 10/466,740

(22) PCT Filed: Oct. 24, 2001

(86) PCT No.: PCT/CH01/00631

§ 371 (c)(1),
(2), (4) Date: Jul. 17, 2003

(87) PCT Pub. No.: WO02/057164

PCT Pub. Date: Jul. 25, 2002

(65) Prior Publication Data

US 2004/0061271 A1 Apr. 1, 2004

(30) Foreign Application Priority Data

Jan. 19, 2001 (CH) ..... 84/01

(51) Int. Cl.
*B65H 5/30* (2006.01)

(52) U.S. Cl. ..... 270/52.27; 270/52.26; 270/52.29; 270/52.14

(58) Field of Classification Search ..... 270/52.26, 270/52.27, 52.29, 52.14, 52.16, 52.19, 52.23, 270/58.23, 58.26, 58.29
See application file for complete search history.

(56) References Cited

U.S. PATENT DOCUMENTS 4,477,067 A 10/1984 Wise ..... 270/55
4,605,213 A 8/1986 Hechler ..... 270/55
4,641,825 A * 2/1987 Mowry et al. ..... 270/52.26

(Continued)

FOREIGN PATENT DOCUMENTS

EP 1 020 385 A1 7/2000

OTHER PUBLICATIONS

International Search Report Corresponding to International Application No. PCT/CH01/00631 From European Patent Office Dated Feb. 22, 2002.

*Primary Examiner*—Patrick Mackey
(74) *Attorney, Agent, or Firm*—Brinks Hofer Gilson & Lione

(57) ABSTRACT

The processing conveyer device (10) has a plurality of receiving elements (18) that are arranged one behind the other and are driven in a circulatory direction, said elements having a support element and a base element for supporting the printing products laterally and from below, in addition to a saddle-type bearing element for receiving folded printing products astride said element. Feed stations (28) are arranged along the circulatory track (12) of the receiving elements (18). A respective opening device, which can be activated and deactivated, is allocated to said feed stations, for selectively opening the folded printing products (24) that are to be fed by the receiving elements. The feed stations (28) can selectively introduce printing products (24) into the receiving elements (18) or can place folded printing products (24), which have been opened, astride the bearing element. A respective removal station (56, 56') is located between the two groups of feed stations (28), whereby at least one of said stations can be deactivated. The device can be used in a wide variety of applications for producing various finished products.

14 Claims, 8 Drawing Sheets

U.S. PATENT DOCUMENTS

| | | | | |
|---|---|---|---|---|
| 5,052,666 | A | 10/1991 | Hansch | 270/55 |
| 5,094,438 | A | 3/1992 | Reist et al. | 270/55 |
| 5,104,108 | A | 4/1992 | Honegger | 270/55 |
| 5,248,135 | A * | 9/1993 | Leu | 270/52.27 |
| 5,425,837 | A | 6/1995 | Hansch | 156/556 |
| 5,462,266 | A * | 10/1995 | Meier | 270/52.16 |
| 5,758,871 | A * | 6/1998 | Schlough | 270/52.27 |
| 5,765,823 | A * | 6/1998 | Meier et al. | 270/58.23 |
| 6,691,996 | B1 * | 2/2004 | Kaya et al. | 270/52.25 |
| 2004/0046306 | A1 * | 3/2004 | Leu et al. | 270/52.26 |

* cited by examiner

Fig.2
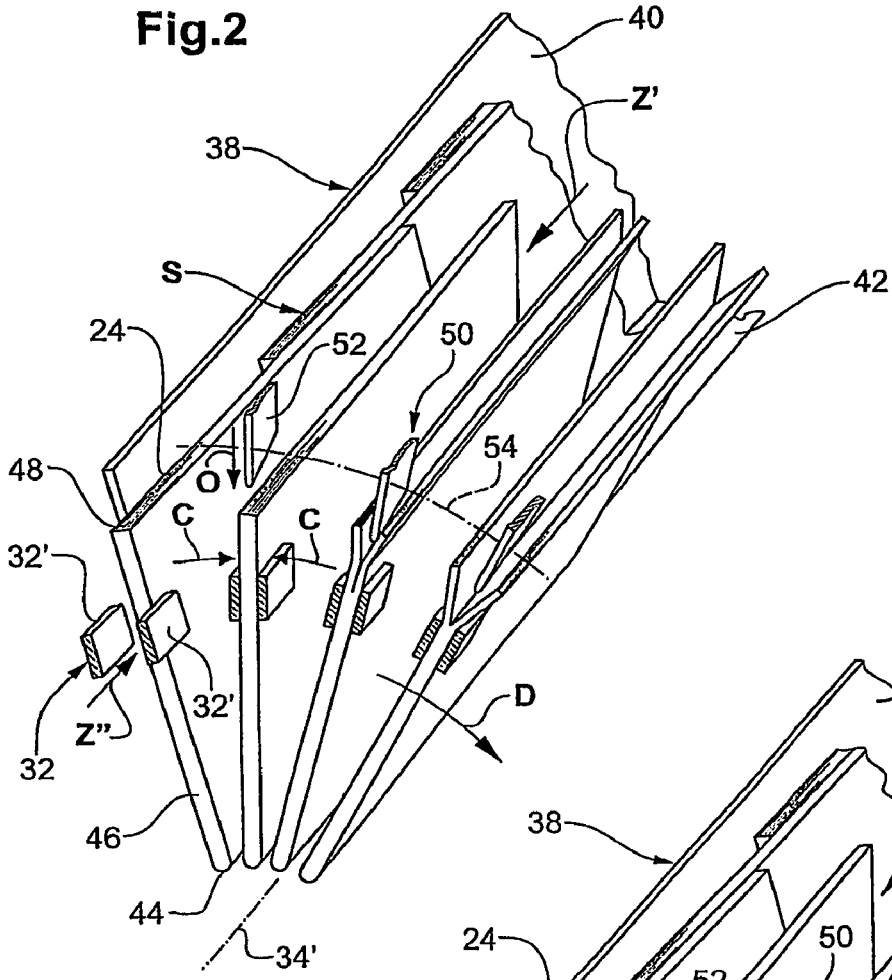
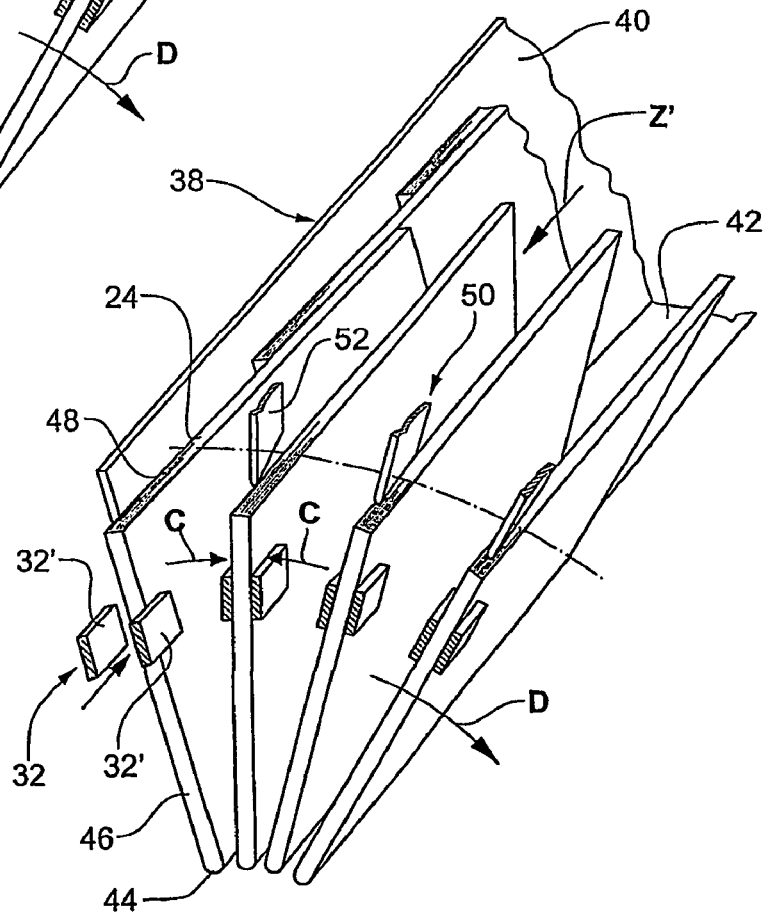
Fig.3

44
24
72
74
26
98
28
48
78
44
24
68'
20
88
84
82
80
48
24
68
22
18
14
96
12
10

28
24
46
74
72
74'
98
92
94
96
20
18
78
Z
A
44
24
VIII
68'
B
68
48
84
10
12
80
14
82
88

Fig.15
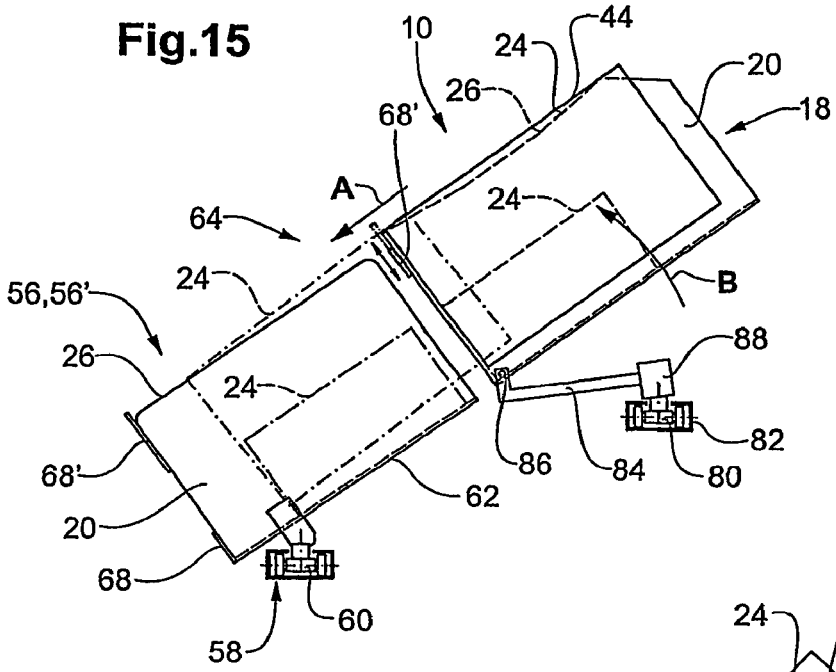
Fig.16
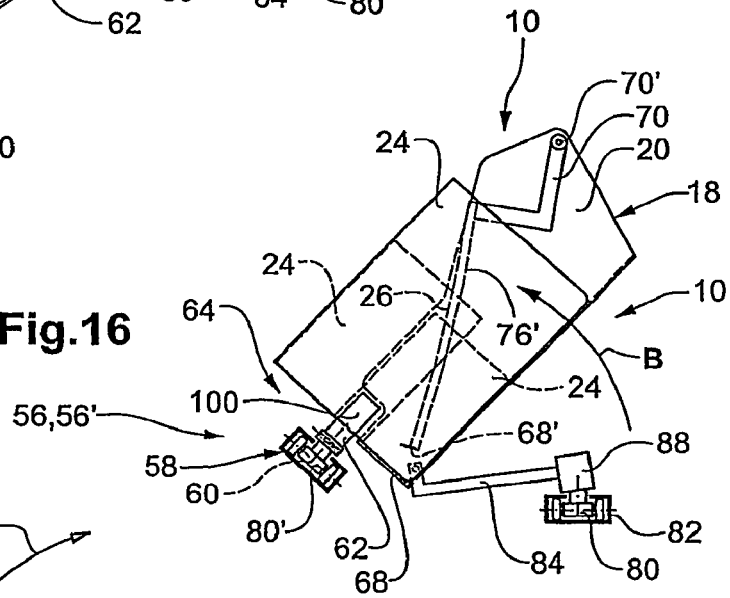
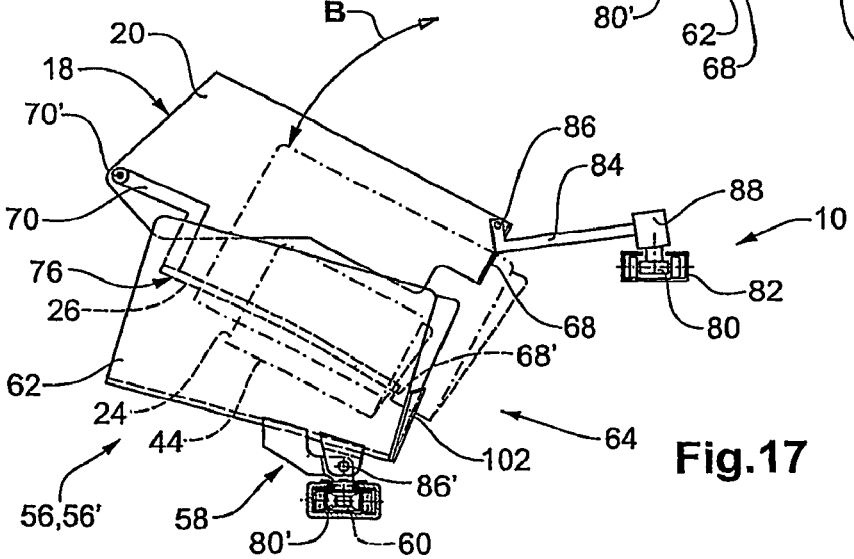
Fig.17

APPARATUS FOR PROCESSING PRINTED PRODUCTS

RELATED APPLICATIONS

This application is a nationalization of PCT Application No. PCT/CH01/00631 filed Oct. 24, 2001. This application claims priority from Swiss Patent Application No. 2001-0084/01 filed on Jan. 19, 2001.

The present invention relates to an apparatus for processing printed products, according to the preamble of patent claim 1.

An apparatus of this type is disclosed by DE-A-33 16 740. It has a circular arrangement of stations and a rotary platform having a large number of holding elements that can be moved past the stations. All of the stations, as viewed in the direction of rotation of the rotary platform, have two diametrically opposite groups of two adjacent cover sheet feed stations, in each case an individual opening station for at least partly folding open the cover sheets introduced into the holding elements, in each case a group of four insertion sheet feed stations and in each case a single output station to accept and transport away printed products collated to form a newspaper.

This known apparatus can be operated in four modes. At a high rotational speed of the rotary platform, the feed stations serve only each second holding element moved past them, it being possible either—if both output stations are active—to produce newspapers with a cover sheet and two insert sheets or—if one of the removal stations is inactive—to produce newspapers with a cover sheet and five insert sheets. At the lower rotational speed of the rotary platform, all holding elements moved past a feed station are served. If both output stations are active, newspapers with a cover sheet and five insert sheets are produced, but if only one removal station is active, newspapers with a cover sheet and ten insert sheets can be produced.

In the two operating modes in which in each case both output stations are active, on both halves of the apparatus identical newspapers are produced but at twice the capacity yet with a smaller number of insert sheets, as compared with the operating modes with only one activated output station. Furthermore, by using the known apparatus, it is only possible in each case to introduce a folded printed product with the fold in front into each holding element, to open said product in the opening station and then to introduce a specific number of further printed products beside one another into the open printed product. The range of end products that can be produced with this apparatus is very restricted.

It is an object of the present invention to provide an apparatus of the generic type which permits the production of a large palette of different end products.

This object is achieved by an apparatus of the generic type which has the features in the characterizing part of claim 1.

Each of the holding compartments, in addition to a supporting element and a base element, also has a saddle-like support. At least one of the feed stations is assigned an opening device which can be switched on and off for the optional opening of folded printed products to be fed to the holding elements. Thus, with the apparatus according to the invention, it is possible not only to introduce printed products into the holding compartments so that they come into contact laterally with one another, but it is also possible, in the same production process, to deposit folded printed products astride the supports. Since the opening device that can be switched on and off is assigned to the feed station, in the event that both output stations are active, different end products can be produced simultaneously on the two production lines of the apparatus. The more feed stations are equipped with opening devices that can be switched on and off, the more flexibly can production be carried out. In the ideal case, each feed station is assigned an opening device.

In a preferred way, the feed stations feed all the folded printed products to the holding elements with the folded edge trailing in the feed direction. With standardized delivery of the folded printed products, these can be introduced into the holding elements with the opening device switched off, so that they come into contact with the base element and the supporting element or a printed product already introduced earlier or, when the opening device is switched on, they can be opened and deposited astride the supports.

In a particularly preferred embodiment of the apparatus according to the invention, each holding element, at least in the feed station, is assigned a deflection element, which is able to deflect a printed product fed to the holding element in such a way that at least part of the printed product fed in is positioned on that side of printed products already held which faces away from the supporting element. As a result, as they are fed in, printed products are prevented in a simple way from coming into conflict with printed products already fed to the holding elements, and printed products are prevented from being damaged.

In a further particularly preferred embodiment of the apparatus according to the invention, the deflection element can be displaced linearly out of the region of the printed products fed in, in a direction running substantially parallel to the support, or the printed products can be displaced off the deflection element. As a result, further printed products can be introduced into the holding elements beside printed products deposited on the support, and then further folded printed products can be deposited on the support.

Further preferred embodiments of the apparatus according to the invention are specified in the further dependent patent claims.

The invention will be described in more detail using embodiments illustrated in the drawing, in which, purely schematically:

FIG. 2 shows, in a perspective illustration, a part of a feed station having clamp elements intended to grip the printed products and opening elements which are intended to open the printed products gripped by the clamp elements;

FIG. 3 shows, in the same illustration as FIG. 2, the part of the feed station shown there, but with the opening device switched off;

FIG. 15 shows a holding element with a moveable stop element, in the region of an output station, during the transfer of the printed products to an output conveyor having output conveyor elements, which are constructed in a similar way to the holding elements;

FIG. 16 shows a holding element in an output station, the output conveyor having clamps to transport the printed products away; and FIG. 17 shows a holding element in the region of an output station, the holding element being pivoted in order to transfer the printed products to an output conveyor element of the output conveyor.

Figure 1:
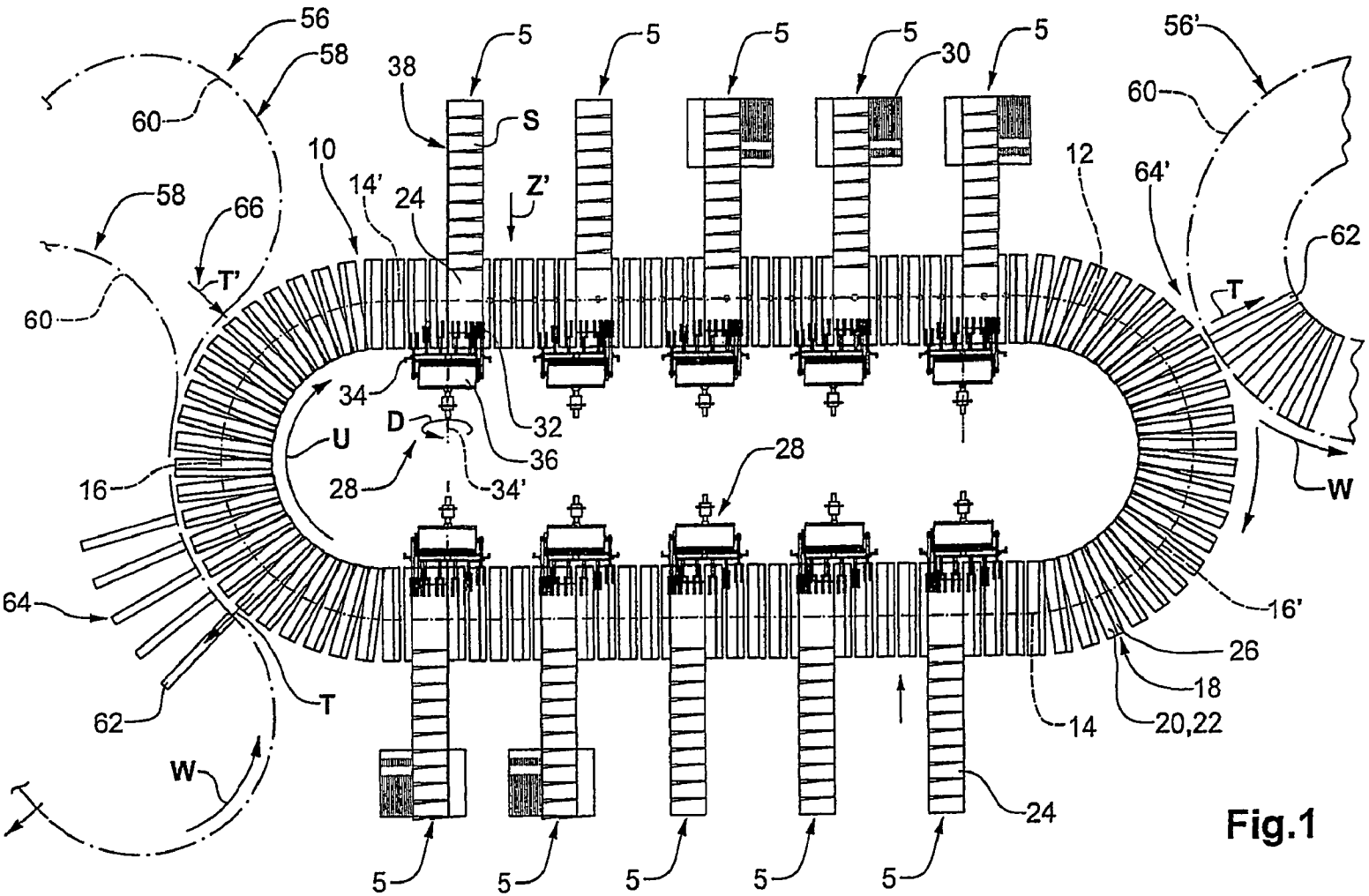
FIG. 1 shows, in plan view, an apparatus according to the invention having two groups of five feed stations each and two output stations arranged between the two groups, it being possible for said stations to be switched on or off as desired.

The apparatus shown in FIG. 1 has a processing conveying device 10 having a circulation path 12. This can intrinsically be shaped as desired, but in the present case is constructed as a circulating system with two rectilinear parallel sections 14, 14' and two semicircular sections 16, 16' connecting these to each other. A large number of holding elements 18, which are arranged one after another and are described in more detail further below, are driven continuously along the circulation path 12 in the circulation direction U. It should firstly be mentioned that each holding element 18 has a supporting element 20 and a base element 22, which are able to support printed products 24 fed to the holding element 18 laterally and from below, and also a saddle-like support 26, which is able to hold folded printed products 24 astride.

The holding elements 18 can be fixed at a predetermined distance to a generally known conveyor chain driven in circulation. However, it is also possible for each holding element 18 to be arranged on an individual, for example rail-guided, slide or carriage, which, at least in some sections, is driven in a known way in the circulation direction U.

In each of the two rectilinear sections 14, 14' of the circulation path 12, five feed stations 28 are arranged one after another, as viewed in the circulation direction U. In the example shown, these are constructed identically. However, it is also indicated that the delivery devices 5 can be different. These can, for example, have an unwinding device, which unwinds printed products 24 wound up in overlapping formation to form a storage coil and feeds them to the relevant feed station 28. However, as shown, the feed station 28 can also have a feeder 30, which pulls printed products 24 off a stack and supplies them to the feed station 28 in overlapping formation.

Feed stations 28 of the type shown and corresponding methods of feeding printed products 24 are disclosed in U.S. Pat. No. 6,832,757 and Published U.S. Patent Applications US-2003-0146563-A1 and US-2003-0146558-A1. Each of the feed stations 28 has a number of clamps 32, which are arranged distributed uniformly along the circumference of a carrier disk 34 shaped like a bell and driven in rotation about its axis of rotation 34'. The carrier disks 34 and their bearings and drive arrangement 36 are located above the processing conveying device 10 and radially on the inside with respect to the circulation path 12. The direction of rotation and rotational speed of the carrier disks 34, and the arrangement of the clamps 32 on the latter, are chosen in such a way that each holding element 18 moved past the feed station 28 is met by a clamp 32, which then has at least approximately the same speed and same circulation direction as the relevant holding element 18. The direction of rotation of the carrier disks 34 is indicated by D.

Furthermore, each of the feed stations 28 has a feed conveyor 38, which is intended to feed printed products 24 arranged in overlapping formation S to the clamps 32 in the direction Z'. It is also possible for the printed products 24 to be fed in singly.

As can be gathered from FIGS. 2 and 3, the feed conveyor 38 has a wall element 40 inclined with respect to the vertical and a base segment 42 projecting therefrom. Printed products 24 arranged in overlapping formation S are conveyed continuously, with their fold 44 resting on the base segment 42 and with one flat side on the wall element 40, in the direction Z', in such a way that each of the clamps 32 led past the downstream end of the wall element 40 in the direction of rotation D can grip a printed product 24 at the leading side edge 46, as viewed in the direction Z', and convey it away in the direction of rotation D. For this purpose, each of the clamps 32 has two clamp tongues 32' which, to grip a printed product 24, first of all in the open state and as indicated by the arrow Z", are moved in the direction opposite to the direction Z' in such a way that they come to lie at a distance on both sides of the printed product 24. The clamp tongues 32' are then moved toward each other into the closed position—see arrows C—the printed product 24 being held at the side edge 46 and at a distance from the open edge 48 opposite to the fold 44, what is known as the bloom. In this connection, open means that the individual sheets of the printed product 24 are not connected to one another along the open edge 48, but that they can be lifted off one another. During operation, it is specifically possible not to provide specific clamps 32 with a printed product.

Furthermore, each feed station 28 has an opening device 50 which can be switched on and off and of which, for better clarity, only the blade-like opening elements 52 are shown. These are driven along a movement path 54, likewise in the direction of rotation D, and are arranged in such a way that each of the clamps 32 which is located between the feed conveyor 38 and the processing conveyor 10, as viewed in the direction of rotation D, is assigned an opening element 52. In their rest position, the opening elements 52, as viewed with respect to the axis of rotation 34', are located in the radial direction outside the clamps 32 and the printed products 34 held by the latter. If a printed product 24 held by a clamp 32 is to be opened, the opening element 52 is moved in the radial direction of the axis of rotation 34', as indicated by the arrow O, as a result of which the opening element 52 sticks into the open edge 48 of the printed product 24 and thus opens the latter and holds it open, in such a way that it can be deposited in the feed direction Z astride the saddle-like support 26 of the relevant support element 18. The opening of printed products 24 is shown in FIG. 2. In FIG. 3, the opening device 50 is switched off, which means that the opening elements 52 do not stick into the printed products 24. In this operating mode, it is of course conceivable not to drive the opening elements 52 in the direction of rotation D.

For completeness, it should be mentioned that individual sheets or a plurality of sheets arranged in a stack form can also be fed in. In this case, the opening device 50 remains inactive.

The apparatus shown in FIG. 1 also has two output stations 56, 56', which are arranged in the region of the semicircular sections 16 and 16' of the circulation path 12. The two output stations 56, 56' can be switched on and off as desired, at least one being active in each case. The output station 56 is illustrated in two different embodiments. Each of the embodiments has an output conveyor 58 with output conveying elements 62 which are arranged one after another and moved in an output conveying direction W and along an intrinsically closed, kidney-shaped output conveying path 60. Said elements are driven in such a way that, in an acceptance region 64, an output conveying element 62 meets each holding element 18 and is moved through the acceptance region 64 in the same direction and aligned with said holding element 18. As indicated by the arrow T, when the output station 56 is activated, in the acceptance region 64 the printed products are transferred from the holding elements 18 to the output conveying elements 62, which are then intended to convey the printed products 24 away in the case of the smaller of the two embodiments shown. In the case of the larger of the two embodiments of the output station 56 shown, the output conveying elements 62 are conveyed through a transfer region 66 in which, as indicated by the arrow T', printed products 24 can be transferred back from the output conveying elements 62 into the holding elements 18 again. In this case, the output station 56 is assigned a processing device, not shown, which is intended to process the printed products 24 fed to the output conveying elements 62 between the acceptance region 64 and the transfer region 66, for example to staple said products, to bind them adhesively, to stick in a supplement or the like. Of course, it is also conceivable to use this embodiment to convey the printed products 24 away from the processing conveying device 10.

In the output station 56', the output conveying elements 62 are driven along a circular output conveying path 60. If the output station 56' is activated, in the acceptance region 64' the printed products 24, as indicated by the arrow T, are transferred from the holding elements 18 to the output conveying elements 62. Here, too, it is possible to process the printed products 24 fed to the output conveying elements 62 downstream of the acceptance region 64, as viewed in the output direction W.

The apparatus shown in FIG. 1 is extremely flexible with regard to its possible uses, and the diversity of finished or intermediate products that can be produced with it from the individual printed products 24 is correspondingly large. However, in the following text, accordingly only some of the possible operating modes will be mentioned.

In a first operating mode, the two groups of feed stations 28 can be operated in series. In this case, each of the processing stations 28 or a part of them supplies the holding elements 18 moved past them with one of the relevant printed products 24 in each case. If the opening devices 50 are switched off, all the printed products 24 supplied by the active feed stations 88 are inserted into the holding elements 18 and come to rest beside one another in the manner of a stack there, being supported at the open edge 48 by the base element 22 and the first printed product 24 fed in resting flat on the supporting element 20. In this case, of course, only one of the output stations 56, 56' is activated. However, it is also conceivable for one, several or all of the opening devices 50 of the feed stations 28 that are in operation to be activated. In this case, the relevant printed products 24 are opened and deposited astride the supports of the holding elements 18 moved past the relevant feed stations 28. If previously unopened printed products 24 have been introduced into the holding elements 18, these are enclosed by the opened printed products 24 fed in later, which means that what is known as "insertion from inside to outside" is made possible. If all the opening devices 50 of the activated feed stations 28 are switched on and, as a result, all the printed products 24 are deposited astride the supports 26, one speaks of "collecting".

In the operating mode with the series connection of the two groups of feed stations 28, it is then possible to use the output station 56' to lead the completed printed products 24 away and to use the output station 56 for the intermediate processing of the printed products 24 fed by means of the first group of feed stations 28, said printed products 24 being transferred to the output conveyor 58 in the transfer region 64 for this purpose and being transported back into the holding elements 18 again by said output conveyor 58 in the transfer region 66.

A further possibility consists in the apparatus according to FIG. 1 being operated in the manner of two production lines independent of each other. In this case, both output stations 56 and 56' are used to convey away the printed products 24 produced which—viewed in the circulation direction U—have optionally been fed unopened and/or opened to the holding elements 18 by the upstream feed stations 28.

Possible embodiments of particularly suitable holding elements 18 are disclosed in Published U.S. Patent Application US-2004-0046306-A1.

Figure 4:
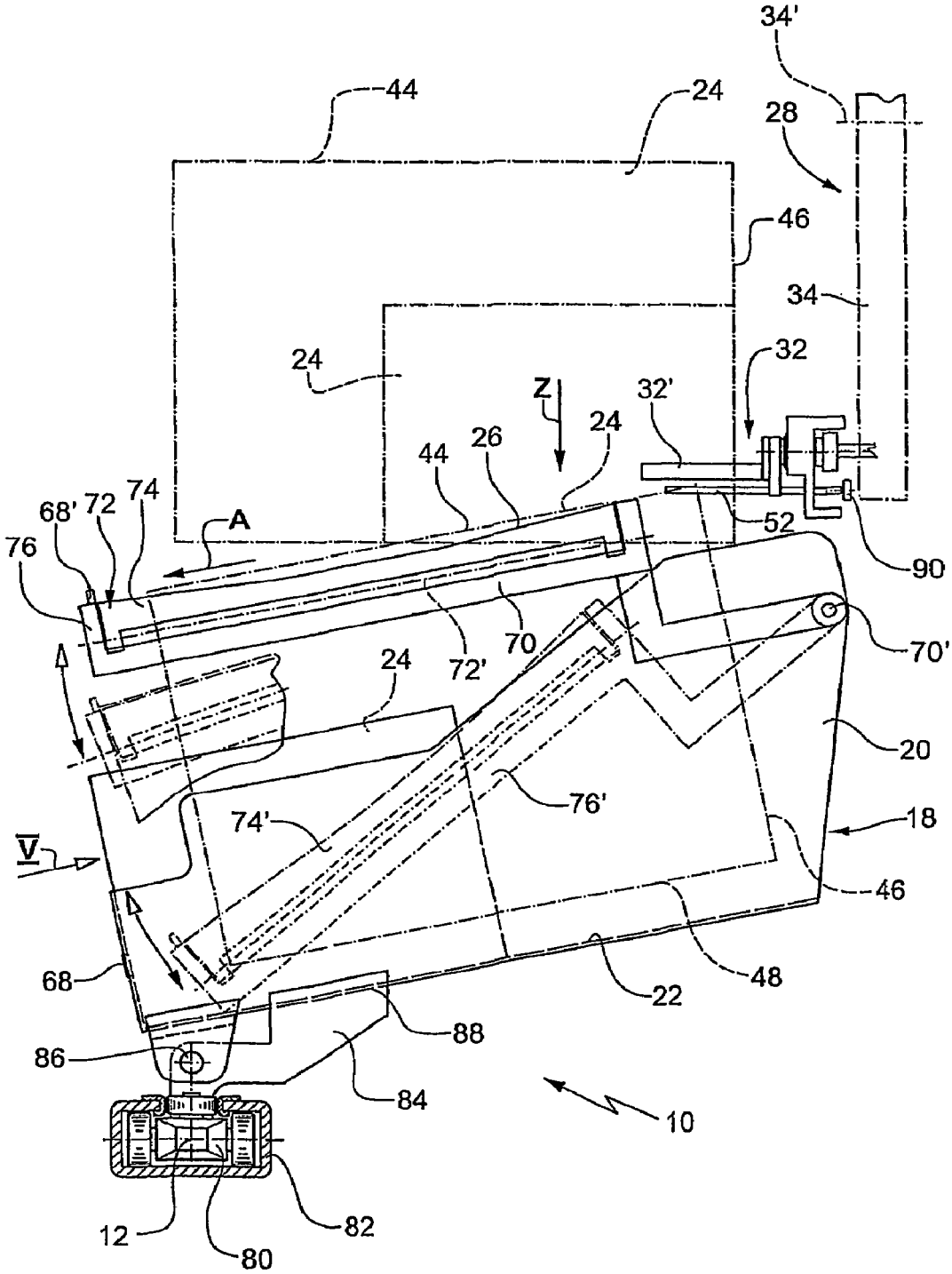
FIG. 4 shows a view of a first embodiment of a holding element and a clamp belonging to a feed station.
Figure 5:
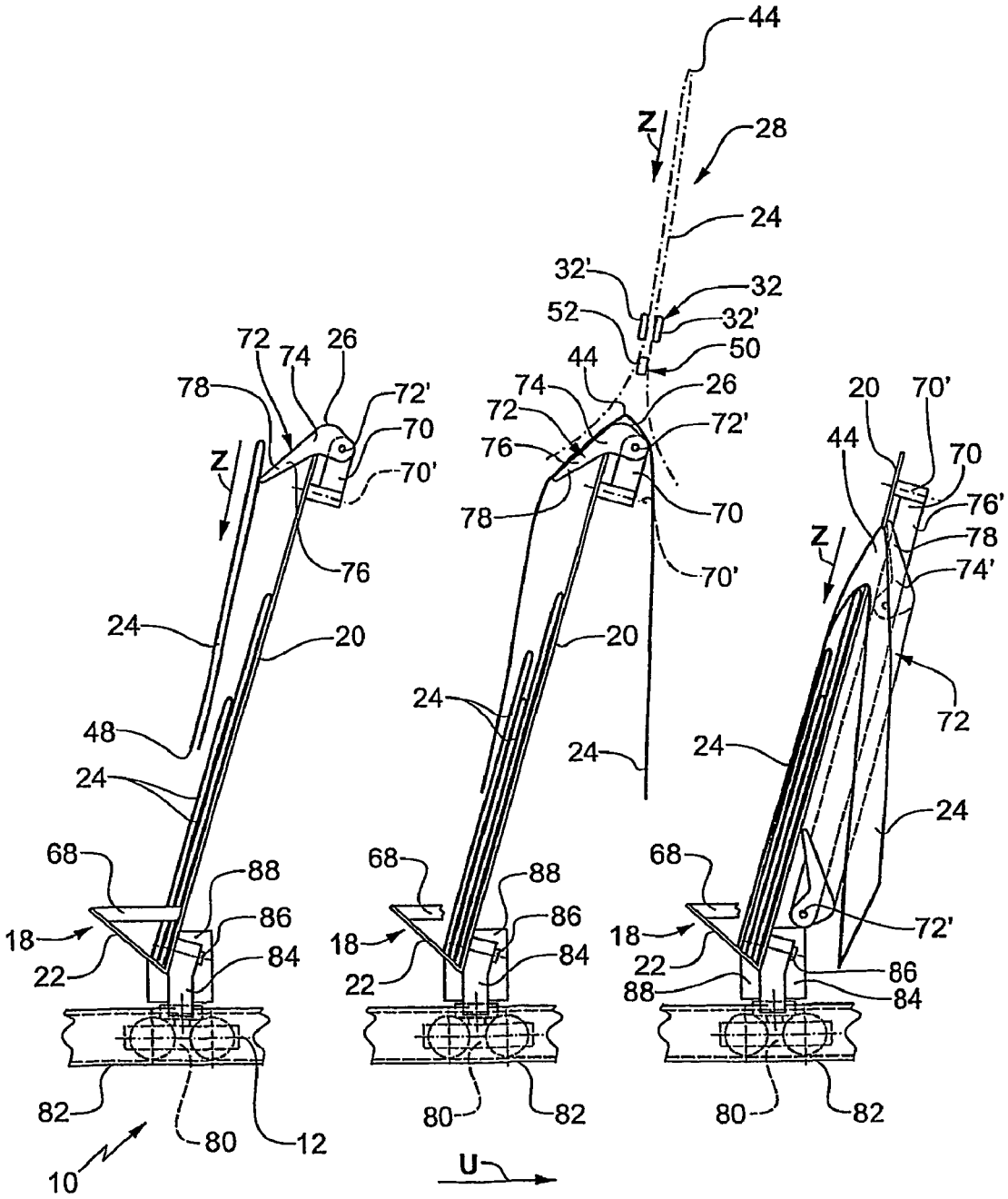
FIG. 5 shows a side view of three holding elements according to FIG. 4 in different phases of feeding printed products.

In the case of the holding elements 18 shown in FIGS. 4 and 5, the supporting element 20 is formed by a flat plate which, at the bottom, is bent over, forming the base element 22. At the left-hand end of the holding element 18 in FIG. 4, the supporting element 20 and the base element 22 are connected to each other by means of a stop element 68. Above the stop element 68, the supporting element 20 is formed in the manner of a step, which provides possible lateral access for the grippers of a gripper transporter to the printed products fed to the holding element 18; see FIG. 16. Adjacent to the, step, the upper edge of the supporting element 20 first runs parallel to the base element 22, then rising obliquely as far as the upper end region of the supporting element 20. In this upper end region, a carrier arm 70 is mounted on the supporting element 20 such that it can be rotated about an axis 70' running at right angles to the supporting element 20. On the carrier arm 70, a deflection element 72 is mounted such that it can be pivoted in the manner of a flap about an axis 72' running parallel to the plane of the supporting element 20. The flap can be pivoted from a deflection position 74 shown in FIG. 4 and in FIG. 5—see the holding element 18 on the extreme left and that in the centre—into a rest position 74' shown on the extreme right in FIG. 5, and back again about the axis 72'. Furthermore, it can be pivoted about the axis 70' from the continuous line in FIG. 4 and in FIG. 5—holding element on the left and holding element in the centre—from a deposition position 76, in which the axis 72' runs at least approximately parallel to the base element 22, into a lowered position 76', which is shown on the extreme right in FIG. 5 in the case of the holding element 18. The cross-section of the deflection element 72 corresponds to an upside down V.

When the carrier arm 70 is located in a deposition position 76 and the deflection element 72 is pivoted into the deflection position 74, the latter forms the saddle-like support 26. Furthermore, it reaches over the supporting element 20 with a deflection web 78 and, with respect to said element, projects in the direction of the base element 22. The deflection web 78 of the deflection element 72 ensures, as shown on the extreme left in FIG. 5 in the case of the holding element 18, that in feed stations 28, printed products fed to the holding element 18 in the feed direction Z—these can be folded, unopened printed products 24—are deflected away from the supporting element 20 in such a way that they do not come into conflict with printed products 24 already fed in earlier, and positions it on the side of the printed products 24 already held which faces away from the supporting element 20. This deflection function is also fulfilled in the case of the astride deposition of folded and opened printed products 24, as indicated in the case of the holding element 18 shown in the centre in FIG. 5. There, the printed product 24 shown dash-dotted, previously held by the clamp 32 and opened by means of the opening element 52 has been deposited on the support 26 in a feed station 28, as illustrated by a continuous line. The part of said printed product 24 deflected by means of the deflection element 72 covers the printed products 24 fed in earlier and lying beside one another.

In order to align the printed product 24 deposited astride the support 26 in the same way as the printed products 24 already introduced earlier into the holding element 18, the deflection element 72 is pivoted about the axis 70 into the rest position 74', which is shown in FIG. 4 by dash-dotted lines and in FIG. 5 by continuous lines in the holding element on the extreme right. Before this pivoting can be carried out, however, the deflection element 72 has to be pivoted out of the deflection position 74 to the rest position 74', so that the deflection element 74 comes to lie on the side of the supporting element 20 which faces away from the base element 22.

When the deflection element 72 is lowered into the rest position 74', firstly the printed product 24 resting on it is moved against the stop element 68, in the direction of arrow A, and secondly it comes to rest with its bottom edge on the base element 22.

As can be gathered in particular from FIG. 4, at the end of the deflection element 72 more remote from the axis 70', the carrier arm 70 has a further stop element 68'. This prevents printed products 24 deposited astride the support 26 not being able to slide off the support 26 because of the latter being arranged to fall obliquely downward.

Each holding element 18 shown in FIGS. 4 and 5 is carried by a carriage 18 which, in a known manner, is freely movably guided in a guide rail 82 with a C-shaped cross-section. From the carriage 80 there projects a supporting arm 84, on which firstly the holding element 18 is mounted about a pivot axis 86 that runs at right angles to the supporting element 20 and which, secondly, forms a channel-like support 88 for the supporting element 20 and the base element 22, on which the holding element 18 rests normally and in particular when moving past the feed stations 28. The pivot axis 86 is preferably located in a vertical plane running in the circulation direction U and can also run in the circulation direction U.

The holding elements 18 can be pivoted about the pivot axis 86 in order firstly to effect the movement of the printed products 24 in the direction A against the stop elements 68, 68' or, secondly, to transfer the printed products 24, as is shown further below using FIGS. 15 to 17 and will be described.

Likewise shown in FIG. 4 is a clamp 32, which holds a printed product 24, indicated dash-dotted, with its clamp tongues 32'. As indicated, said product can have different formats, the side edge 46 being located in the same lateral alignment as the holding element 18. In the case of folded printed products, the folded edge 44 trails, as viewed in the feed direction Z. In FIG. 4, the opening element 52 arranged on the clamp 32 in this embodiment is in the active position and holds the printed product 24 to be fed in open, as indicated in the case of the central holding element 18 in FIG. 5. If printed products 24 are to be fed to the holding element 18 in the unopened position, the opening element 52 is moved out of the region of the printed products 24 in a translational or rotational manner by means of a control member 90. For completeness, it should be mentioned that all the movements in connection with the holding element 18 according to FIGS. 4 and 5 can be triggered and carried out by means of control members, such as controlled slotted guides and the like. In a preferred way, the movable elements are prestressed, for example by means of springs, in the direction of the one position, so that they have to be moved only in the opposite direction by means of the control members.

Figure 6:
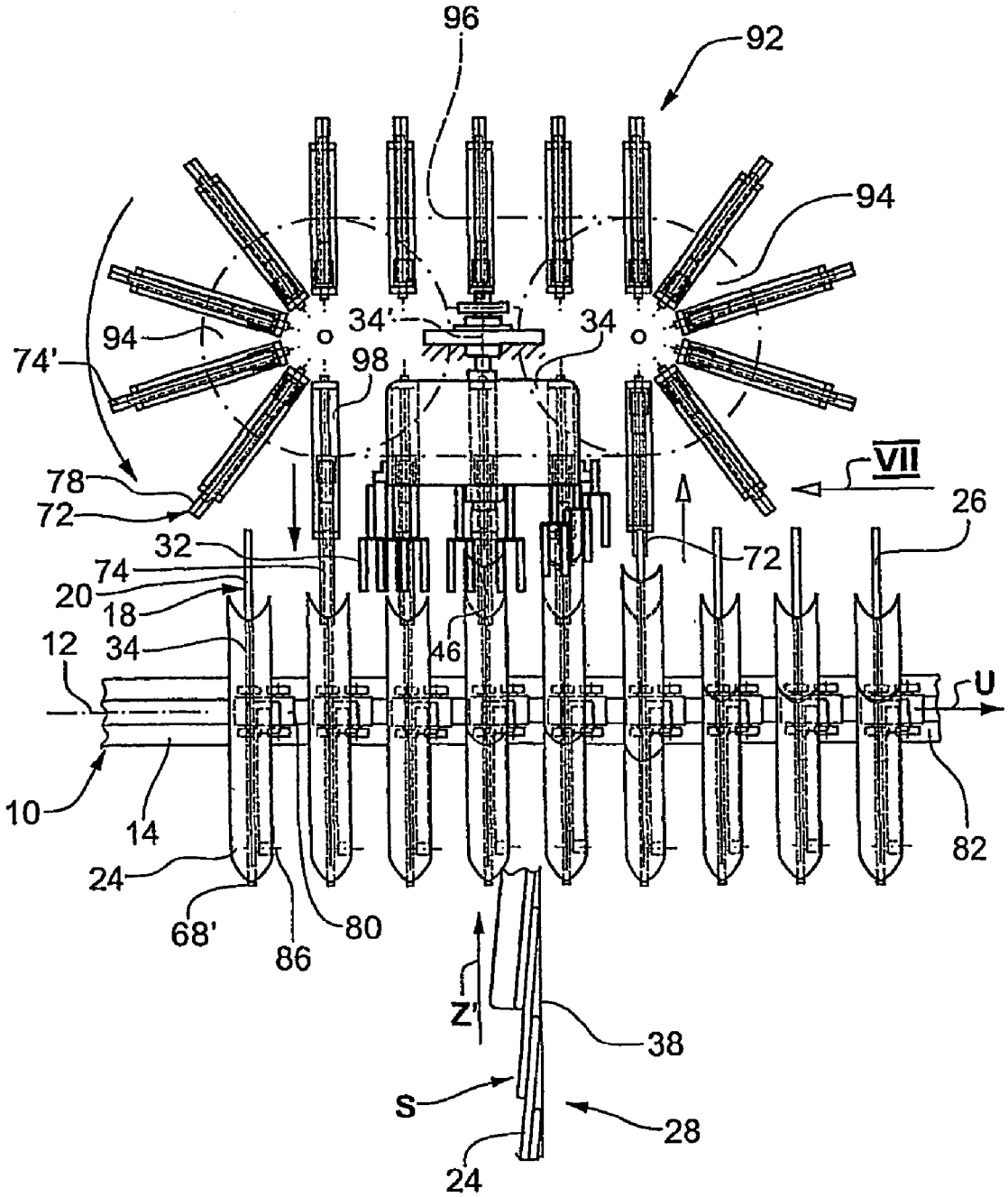
FIG. 6 shows a plan view of a number of support elements in a feed station and a circulating system assigned to the latter and having deflection elements.
Figure 8:
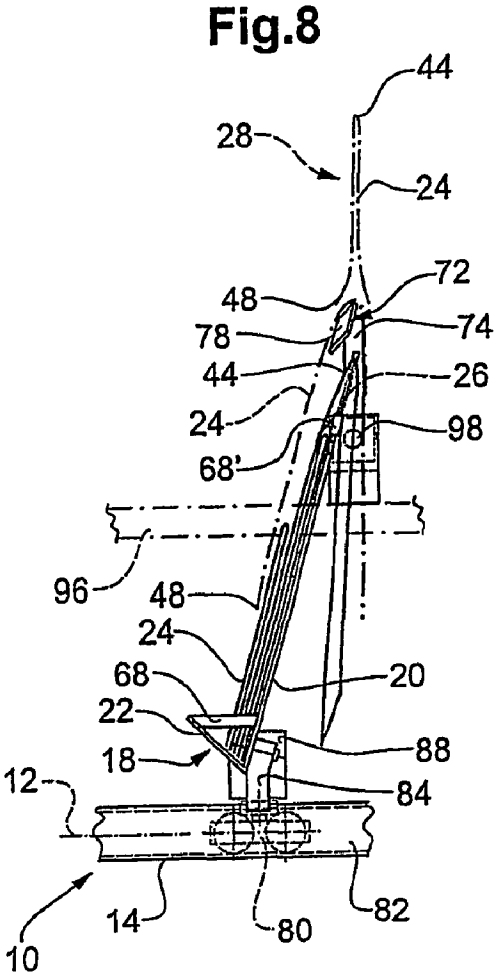
FIG. 8 shows a side view in the direction of the arrow VIII of FIG. 7 of the apparatus shown in FIG. 6.
Figure 7:
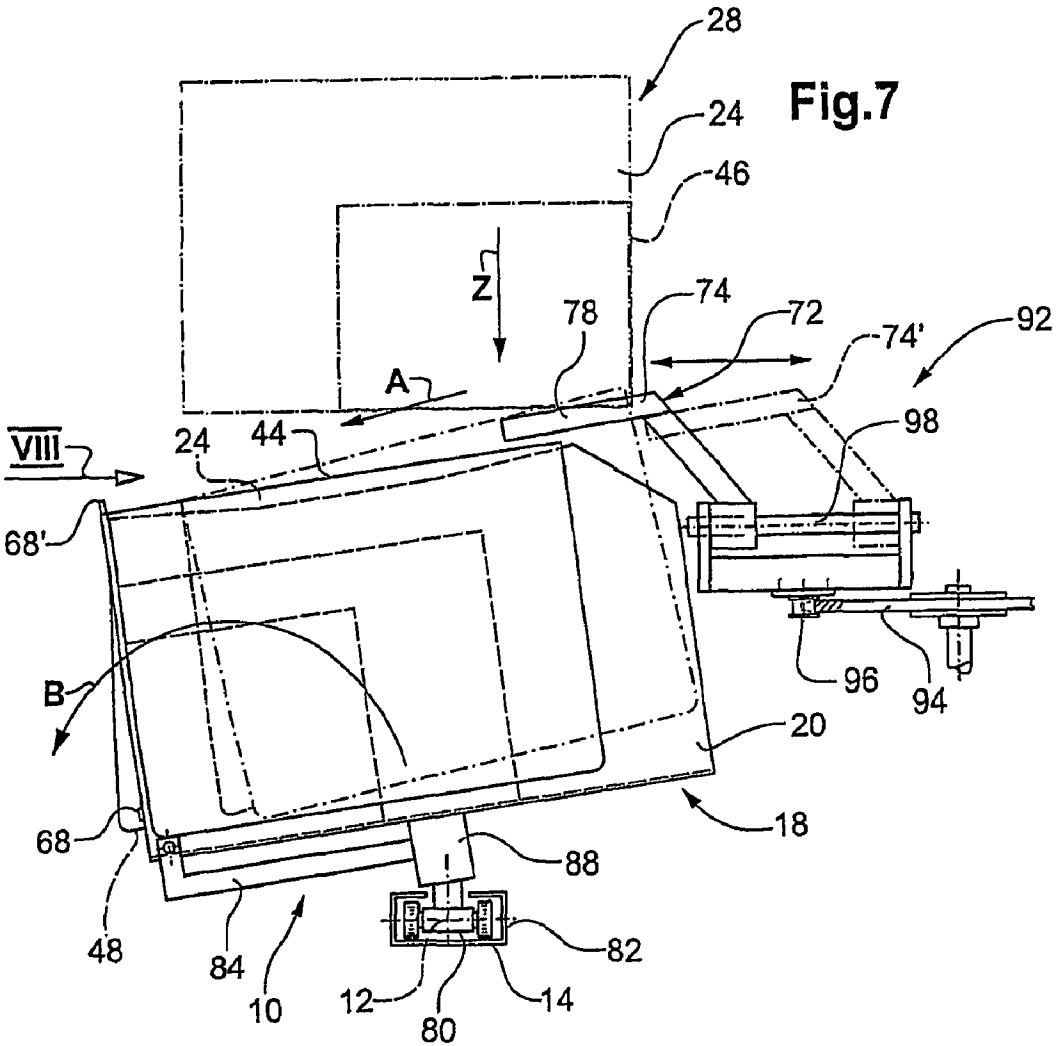
FIG. 7 shows the view in the direction of the arrow VII of FIG. 6 of a holding element and of the circulating system having deflection elements.

In the embodiment of the apparatus shown in FIGS. 6 to 8, the holding elements 18 of the processing conveying device 10 are constructed very simply, they have a substantially rectangular supporting element 20 made of sheet metal, which also forms the base element 22 as a result of being bent over. The upper edge of the supporting element 20 forms the support 26 for holding folded printed products 24 astride. On the side of the holding element 18 which is at the bottom in FIG. 6 and on the left in FIG. 7, the supporting element 20 is connected to the base element 22 by means of a stop element 68. On the same side, a further stop element 68' projects beyond the support 26. Adjacent to the stop element 68, the supporting element 20 is mounted such that it can be pivoted about a pivot axis 86 which runs at right angles to said element and which in turn is fitted to a supporting arm 84. The latter projects in the manner of an outrigger on a support 88 for the holding element 18, which in turn is fixed to an individual carriage 80 guided in the guide rail 82. As indicated by the arrow B in FIG. 7, the holding element 18 can be pivoted from the position shown there, which it assumes when moving past the feed stations 28, in order to ensure the alignment of the printed products 24 fed to the holding element 18 on the stop element 68 and/or further stop elements 68' by moving in the direction of arrow A, or to transfer the printed products 24 to the output conveyor 58 in one of the output conveying stations 56, 56'.

In FIG. 6, a feed station 28 is further shown in part. The feed conveyor 38 brings the printed products 24 in overlapping formation S in the direction Z' to the clamps 32, which are arranged on the bell-like carrier disk 34 such that they can be displaced in the direction of the axis of rotation 34'. In order to grip a printed product 24 in each case, the relevant clamp 32 is moved out in the direction opposite to the direction Z' and then remains in this position until the relevant printed product 24 is discharged to the associated holding element 18. At the same time as the clamp 32 is opened, the latter is pulled back in the direction Z out of the region of the printed product 24. The printed products 24, held by the clamps 32, are rotated through around 180° about the axis 34'.

The feed station 28 is assigned a deflection device 92, which has deflection elements 72 arranged at a distance from the holding elements 18 on a chain 96 guided around sprockets 94. The active run of the chain 96 runs underneath the carrier disk 34, parallel to the guide rail 82 of the holding elements 18. The chain 96 is driven at the same speed as the holding elements 18 as they move past the feed station 28, in such a way that a deflection element 72 coincides with each holding element 18 and these move synchronously past the feed station 28. Each deflection element 72 is mounted in the manner of a slide on a guide shaft 98 which is fixed to the chain 96 and can also be two guide shafts or a guide of a different design, such that it can be displaced at right angles to the chain 96 and in the horizontal direction. The deflection element 72 having a deflection web 78, which is designed in the manner of an outrigger and which is arranged at least approximately parallel to the support 26, is moved outward in the radial direction into the deflection position 74 when the active run reaches a rest position 74' which is set back with respect to the circulation of the chain. After passing the feed station 28 and before or when reaching the downstream end of the active run, the deflection element 72 is pulled back again into the rest position 74'. It is also possible to drive the deflection elements 72 individually.

As can be gathered in particular from FIG. 8, the deflection element 72 deflects unopened printed products 24 fed to the holding element 18 in such a way that they are positioned beside printed products 24 already located in the holding element 18. Folded and opened printed products 24, as can be gathered in particular from FIG. 7, come to rest astride the deflection element 72 and the support 26 on the supporting element 22. In this case, the part of the printed product 24 facing the base element 22 is deflected in such a way that it is positioned on the side of printed products 24 already held that faces away from the supporting element 20; see FIG. 8 the printed product 24 indicated dash-dotted. By virtue of the deflection element 72 being pulled back into the rest position 74', it releases the relevant printed product 24, which then comes to rest completely on the support 26.

With the embodiment shown in FIGS. 6 to 8, it is possible to deposit further printed products 24 beside a printed product 24 deposited astride the support 26, and then in turn to enclose these by means of a folded and opened printed product 24.

Figure 11:
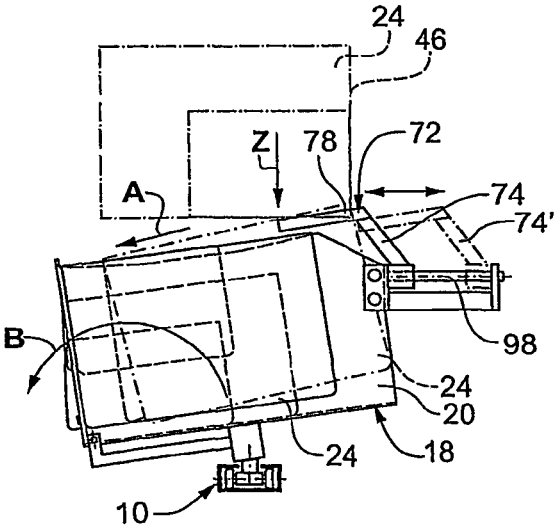
FIG. 11 shows a view of a further embodiment of a holding element having a deflection element displaceably arranged thereon.

As FIG. 11 shows, the guide shaft 98 can be fixed to the supporting element 20, so that each holding element 28 has its own deflection element 72, which functions in the same way as that shown in FIGS. 6 to 8 and described further above, and can be displaced from the rest position 74' into the deflection position 74 and back again.

Figure 9:
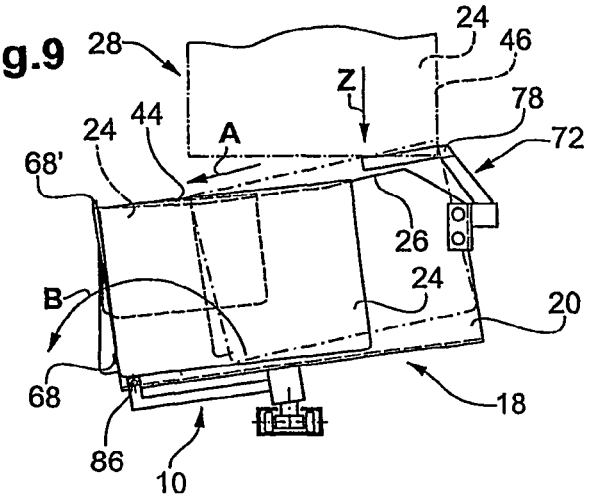
FIG. 9 shows a view of a further embodiment of a holding element having a deflection element fixedly arranged thereon.
Figure 10:
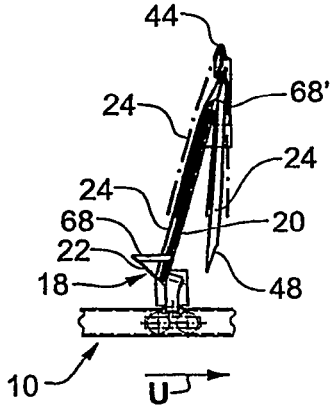
FIG. 10 shows a side view of the holding element shown in FIG. 9.

In the embodiment shown in FIGS. 9 and 10, the deflection element 72, which has the same form as in the embodiments according to FIGS. 6 to 8, 11 and 12, is fixedly arranged on the supporting element 20 on the side facing away from the stop elements 68, 68'. The distance between the stop element 68' and the free end of the deflection web 78, measured in the longitudinal direction of the holding element 18, is in this case greater, however, than the length of the fold 44 of the largest printed products 24 to be processed. The feed stations 28 feed all the printed products 24 in such a way that they come to lie with their side edge 46 in the region of the deflection web 78. The functioning of this embodiment of the deflection element 72 is exactly the same as that described further above.

However, in order to move the folded printed products 24 deposited astride away from the deflection element 72 in the direction of arrow A, in each case after a printed product 24 has been deposited, the holding element 18 is pivoted in the direction of arrow B, so that the printed products 24 slide until they rest on the stop elements 68, 68'. The holding elements 18 are then moved back again into the position shown in FIG. 9.

Figure 12:
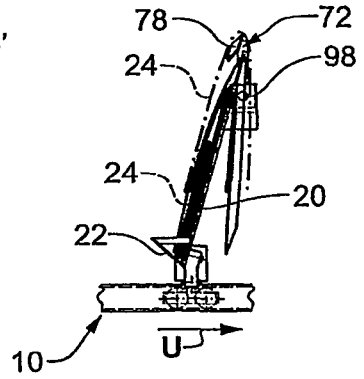
FIG. 12 shows a side view of the holding element shown in FIG. 11.
Figure 13:
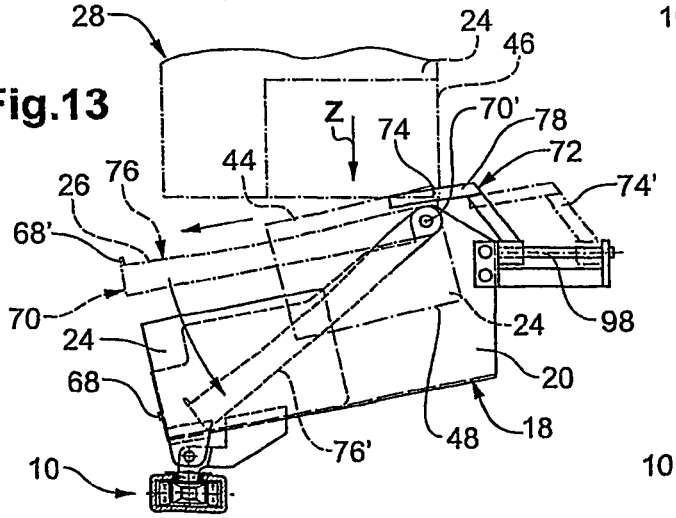
FIG. 13 shows a view of a further embodiment of the holding element having a deflection element displaceably arranged thereon and a pivotable support.
Figure 14:
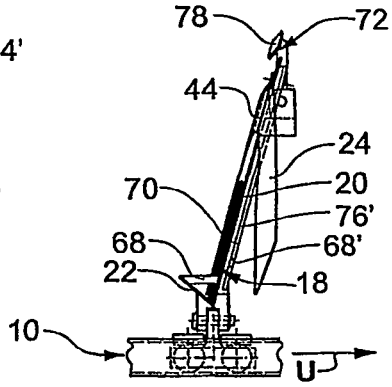
FIG. 14 shows a side view of the holding element shown in FIG. 13.

FIGS. 13 and 14 show a holding element 18 which is very similar to the embodiment according to FIGS. 4 and 5. The carrier arm 70, which can be pivoted about the axis 70' on the supporting element 20, forms the saddle-like support 26. It can be lowered from the deposition position 76 indicated dash-dotted in FIG. 13 into the lowered position 76' indicated dashed. As it is moved past the feed stations 28, the carrier arm 70 is in the deposition position 76. The deflection element 72, as opposed to the embodiment according to FIGS. 4 and 5, is not arranged on the carrier arm 70 but of the same design as shown in FIGS. 11 and 12. The guide shaft 98, on which the deflection element 72 is displaceably mounted, is fixed to the supporting element 20. The deflection web 78 of the deflection element 72 again ensures that the printed products 24 fed in come to lie beside the printed products 24 already deposited. If folded printed products 24 are to be deposited astride, these come to rest on the deflection web 78 and the support 26 formed by the carrier arm 70. By virtue of the deflection element 72 moving back into the rest position 74', the relevant printed product 24 then comes to lie completely on the support 26. Lowering the carrier arm 70 into the lowered position 76' then makes it possible to align all the printed products 24, namely those introduced into the holding element 18 and those deposited thereon, with respect to the base element 22 and the stop element 68.

FIG. 15 shows a holding element 18 as described in connection with FIGS. 7 and 8 in an acceptance region 64 for transferring the printed products 24 fed to the holding element 18 to an output conveying element 62 of the output conveyor 58 of an output station 56 or 56'. The stop elements 68, 68' are mounted on the supporting element 20 such that they can move, in such a way that they can be moved out of the range of action on the printed products 24, as indicated by using the double arrow in the example of the further stop element 68'. The output conveying element 62 is of substantially the same design as the holding element 18. It likewise has an at least approximately rectangular supporting element 20, a base element 22 and stop elements 68, 68'.

For the transfer of the printed products 24, the holding element 18 of the processing conveying device 10 is pivoted about the pivot axis 86 in such a way that the force of gravity acting on the printed products 24 overcomes the frictional force between the printed products 24 and the holding element 18. The output conveying element 62 is arranged in substantially the same oblique position, but is positioned obliquely underneath the holding element 18 in such a way that the base elements 22 of the holding element 18 and of the output conveying element 62, and also the supports 26 on the supporting elements 20 of the holding element 18 and of the output conveying element 62, are at least approximately aligned with one another. In a preferred way, the base element 22 and the support 26 of the output conveying element 62 are arranged somewhat below the straight line defined by the base element 22 and the support element 26 of the holding element 18. With an aligned arrangement of the holding element 18 and of the output conveying element 62, the stop elements 68, 68' are moved out of the range of action on the printed products 24, after which the printed products 24 automatically slide onto the output conveyor element 62 in the direction of arrow A, as shown by using the printed products indicated dash-dotted.

FIG. 16 shows a holding element according to FIGS. 4 and 5 in an acceptance region 64 of an output conveyor 58. The latter is constructed as a gripper transporter and has controlled gripper tongues 100 arranged on rail-guided carriages 80'. Before reaching the acceptance region 64, the carrier arm 70 has been pivoted into the lowered position 76', so that all the printed products 24 are aligned with respect to the base element 22 and the stop element 68. However, in this regard, FIG. 16 shows an exception which occurs when a folded printed product 24 has been deposited astride another printed product 24 of larger format. In this case, the smaller-format printed product 24 is aligned above the larger-format printed product 24 with respect to the base element 22 and directly with respect to the stop element 68. For the transfer of the printed products 24 to the output conveyor 58, the holding element 18 is again pivoted about the pivot axis 86 into a more oblique position. The holding element 18 and the output conveyor 58 are in this case aligned with each other in such a way that the gripper tongues 100 grip the printed products 24 from the side of the stop element 68, specifically in that recess in the supporting element 20 which is formed by the step-like shape. If the stop element 68 is designed to be movable, the output conveyor 58 can carry the gripped printed products 24 away, for example in the horizontal direction. If, however, the stop element 68 is immovable, after the gripper tongues 100 have been closed, the output conveying path 60 must run with a slope with respect to the circulation path 12 of the holding elements 18, in order to lift the printed products 24 out of the holding element 18.

FIG. 17 shows an embodiment of the output conveyor 58 in which the output conveying elements 62 are formed as holding pockets with a V-shaped cross section. The bottom of the pocket extends falling obliquely in the direction of the processing conveying device 10, but is arranged lower than the latter. At the bottom lateral end, the output conveying elements 26 have a side stop element 102. In the acceptance region 64, the holding element 18, which in the present case is of the same design as the holding element 18 of FIG. 16, is again aligned with the relevant output conveying element 62, specifically in such a way that when it is pivoted about the pivot axis 86 it can engage in the output conveying element 62. In order to prevent printed products 24 placed astride slipping during this pivoting movement, the carrier arm 70 can remain in the deposition position 76. In the case of this type of transfer, the printed products 24 are turned in such a way that the edges located at the top in the region of the processing conveying device 10 are located at the bottom in the output conveyor 58. Following the transfer of the printed products 24, the holding element 18 is pivoted back again until it rests on the support 88. The output conveying element 62 is mounted on the associated carriage 80' such that it can be pivoted about a pivot axis 86' in the same way as in the case of the holding element in FIGS. 4 and 5. In order to permit the acceptance of the printed products 24, it is conceivable to move the output conveying element 62 toward the holding element 18 and then to pivot it back again until it rests on the support again. In order to discharge the printed products 24, for example into a transfer region 66, the output conveying elements 62 can be pivoted about their pivot axis 86 in such a way that the printed products 24 fall out of them. The transfer can also be carried out in a manner analogous to FIG. 15.

Of course, the feed stations 28 and, in particular, the opening devices 50 can be constructed differently. For example, it is conceivable to use known feeders which—where desired—are provided with an opening device that can be switched on and off. It is important that printed products 24 can be fed to the holding elements 18 in the unopened and in the opened state. The holding elements and deflection elements can also be constructed differently or can form a combination of the various embodiments shown.

Deflection devices 92, as shown in FIGS. 6 to 8, can if required also be assigned only to those feed stations 28 where they are needed.

The invention claimed is:

1. An apparatus for processing printed products, comprising:

a) a plurality of holding elements arranged one after another and moveable along a circulation path in a circulation direction;

b) each of said holding elements having at least a supporting element and a base element, said supporting element and base element in each holding element being adapted to support printed products either laterally or from below;

c) a plurality of feed stations positioned for feeding printed products to the holding elements while said holding elements are moved past the feed stations, each of said feed stations including a plurality of clamps movable in approximately the same direction and at approximately the same speed as the holding elements, each of said clamps being adapted to receive a printed product, rotate the printed product about an axis extending parallel to a radial direction with respect to the circulation path and transfer the printed product to a holding element;

d) a first output station and a second output station arranged along said path and, as seen in the circulation direction, at least two of the feed stations arranged along said path and between said first and second output stations and at least two of the feed stations arranged along said path and between said second and first output stations, at least one of said first and second output stations being independently controlled whereby it can be selectively inactivated;

e) each of said holding elements also including a straddle support element for holding a folded printed product astride; and f) at least one of said feed stations having a selectively operable opening device for optionally opening folded printed products, said at least one feed station being capable of feeding printed products into a holding element or depositing folded printed products which have been opened onto respective straddle support elements.

2. The apparatus as claimed in claim 1, wherein the feed stations feed all the folded printed products to the holding elements with the folded edge trailing.

3. The apparatus as claimed in claim 1 or claim 2 wherein the feed stations feed all the printed products to the holding elements with the same lateral alignment with respect to said holding elements.

4. The apparatus as claimed in claim 1, wherein each holding element, at least in the feed stations, is assigned a deflection element, which is moved at substantially the same speed as the holding element and in the circulation direction and is able to deflect a printed product fed to the holding element in such a way that at least part of the printed product fed in is positioned on the side of printed products already held that faces away from the supporting element.

5. The apparatus as claimed in claim 4, wherein each holding element has a deflection element.

6. The apparatus as claimed in claim 4, wherein the deflection element has a deflection surface which runs at least approximately parallel to the supporting element and which is spaced apart from a contact plane defined by the supporting element.

7. The apparatus as claimed in claim 4, wherein the deflection element is movable relative to the holding element, at least between a deflection position, in which it is able to deflect printed products, and a rest position, in which it is not able to deflect printed products.

8. The apparatus as claimed in claim 7, wherein the deflection element is displaceable linearly, in a direction running substantially parallel to the supporting element, between the deflection position and the rest position and/or is pivotable between these positions about an axis running substantially at right angles to the supporting element.

9. The apparatus as claimed in claim 1, wherein the holding element has a stop, with which at least printed products resting astride the straddle support element are stopped during a movement in the direction of the supporting element.

10. The apparatus as claimed in claim 1, wherein the holding element is pivotable about an axis running substantially at right angles to the supporting element or at least approximately parallel to the circulation path.

11. The apparatus as claimed in claim 1, wherein at least one of the output stations has an output conveyor with output conveying elements which are arranged one after another and moved in an output conveying direction and along an output conveying path and which, in an acceptance region, accept from the holding elements the printed products fed to the after.

12. The apparatus as claimed in claim 11, wherein the output conveyor is able to discharge the printed products accepted in the acceptance region to the holding elements again, in a transfer region spaced apart from the acceptance region.

13. The apparatus as claimed in claim 1, wherein each feed station is assigned an opening device that can be switched on and off.

14. A method of simultaneously producing different printed products by bringing together component printed products being fed in, comprising the steps of:

(a) arranging a plurality of holding elements one after another and moveable along a circulation path in a circulation direction, each of said holding elements having a supporting element for supporting printed product laterally, a base element for supporting printed products from below and a straddle supporting element for supporting printed products astride:

(b) arranging a plurality of feed stations adjacent said path and positioned for feeding printed products to the holding elements while said holding elements are moved past the feed stations, each of said feed stations including a plurality of clamps movable in approximately the same direction and at approximately the same speed as the holding elements, each of said clamps being adapted to receive a printed product, rotate the printed product about an axis extending parallel to a radial direction with respect to the circulation path and transferring the printed product to a holding element, at least one of said feed stations having a selectively operable opening device for optionally opening folded printed products, said at least one feed station being capable of feeding printed products into a holding element or depositing folded printed products which have been opened onto respective straddle support elements;

(c) arranging a first output station and a second output station along said path with, as seen in the circulation direction, at least two of said feed stations arranged along said path between said first and second output stations and at least two of said feed stations arranged along said path between said second and first output stations, at least one of said first and second output stations being independently controlled whereby it can be selectively inactivated; and (d) feeding printed products from one or more of said feed stations selectively onto a supporting element, a base element or a straddle support element in each of said holding elements and, where a printed product is being fed onto a straddle support element, opening a folded printed product before it is deposited astride said straddle support element.

* * * * *